US010299321B1

(12) United States Patent
Trask et al.

(10) Patent No.: US 10,299,321 B1
(45) Date of Patent: May 21, 2019

(54) MULTI-CHANNEL WHITE LIGHT TUNING

(71) Applicant: EATON INTELLIGENT POWER LIMITED, Dublin (IE)

(72) Inventors: Russell Scott Trask, Sharpsburg, GA (US); Raymond Janik, Fayetteville, GA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 15/589,710

(22) Filed: May 8, 2017

(51) Int. Cl.

| | |
|---|---|
| ***G09G 3/20*** | (2006.01) |
| ***G09G 3/32*** | (2016.01) |
| ***G09G 5/02*** | (2006.01) |
| ***H05B 33/08*** | (2006.01) |
| ***F21V 29/70*** | (2015.01) |

(52) U.S. Cl.
CPC ..... *H05B 33/0806* (2013.01); *G09G 3/2003* (2013.01); *G09G 3/32* (2013.01); *G09G 5/02* (2013.01); *H05B 33/0803* (2013.01); *G09G 2310/0264* (2013.01); *G09G 2330/028* (2013.01)

(58) Field of Classification Search
CPC ..... H05B 37/0254; H05B 33/0806; H05B 33/0818; H05B 33/0857; H05B 33/0887; H05B 37/0236; H05B 37/03; F21Y 2115/10; F21Y 2113/13; F21Y 2105/10; F21Y 2105/12
USPC ..... 315/152, 291, 151, 192, 246, 250
See application file for complete search history.

(56) References Cited

U.S. PATENT DOCUMENTS

| | | | | |
|---|---|---|---|---|
| 8,890,926 | B2 * | 11/2014 | Tandon | H04N 7/157 348/14.08 |
| 2007/0040512 | A1 * | 2/2007 | Jungwirth | H05B 33/086 315/159 |
| 2011/0248648 | A1 * | 10/2011 | Liu | G09G 3/3406 315/294 |
| 2013/0320862 | A1 * | 12/2013 | Campbell | H05B 37/02 315/152 |
| 2014/0312777 | A1 * | 10/2014 | Shearer | H05B 33/0869 315/152 |
| 2015/0351187 | A1 * | 12/2015 | McBryde | H05B 33/086 315/185 R |
| 2018/0035508 | A1 * | 2/2018 | Hick | H05B 37/0272 |

OTHER PUBLICATIONS

Finelite; Tunable White Luminaires; Fine Turn Control Systems; Aug. 2016.
SIRS Electronics; DMX-CON4V2 Data Sheet; Oct. 17, 2016.

* cited by examiner

*Primary Examiner* — Wei (Victor) Chan
(74) *Attorney, Agent, or Firm* — King & Spalding LLP

(57) ABSTRACT

A driver of a lighting fixture includes a power circuitry configured to provide a first current to a first string of light emitting diodes (LEDs), a second current to a second string of LEDs, and a third current to a third string of LEDs that emit a third white light. The driver further includes a controller that controls the power circuitry to change an amount of the first current, an amount of the second current, and an amount of the third current to adjust a CCT of an output light provided by a lighting fixture. The output light includes two white lights from among the first white light, the second white light, and the third white light, where the first current, the second current, and the third current are adjustable independent of each other.

14 Claims, 5 Drawing Sheets

MULTI-CHANNEL WHITE LIGHT TUNING

TECHNICAL FIELD

The present disclosure relates generally to lighting solutions, and more particularly to multi-channel white light tuning.

BACKGROUND

A lighting fixture may be designed to emit light that has a particular Correlated Color Temperature (CCT). For example, an LED light fixture may emit a warm white light (e.g. 2700-3000 K), a cool white light (e.g., 5000-6000 K) or a light with a CCT between warm and cool white lights. A lighting fixture may also be designed to allow adjustability of the CCT of the light provided by the lighting fixture. For example, a lighting fixture may include LEDs that emit a warm white light and LEDs that emit a cool white light, and the intensity levels of the warm white light and the cool white light may be adjusted to produce an output light with a desired CCT. However, the CCT of the output light generally moves away from the black-body curve as the CCT of the output light moves toward the halfway point between the CCTs of the warm and cool white lights. Further, because of differences in efficiencies of warm light LEDs and cool light LEDs, the intensity of the combined light may undesirably change as current is shifted between the cool light LEDs and the warm light LEDs to make the output light warmer or cooler. Thus, a solution that enables changing the combined CCT such that the combined CCT remains close to the black-body curve while the lumen output remains substantially constant is desirable.

SUMMARY

The present disclosure relates generally to lighting solutions, and more particularly to white light tuning. In an example embodiment, a driver of a lighting fixture includes a power circuitry configured to provide a first current to a first string of light emitting diodes (LEDs) that emit a first white light having a first CCT. The power circuitry is further configured to provide a second current to a second string of LEDs that emit a second white light having a second CCT. The power circuitry is also configured to provide a third current to a third string of LEDs that emit a third white light having a third CCT. The driver further includes a controller that controls the power circuitry to change an amount of the first current, an amount of the second current, and an amount of the third current to adjust a CCT of an output light provided by a lighting fixture. The output light includes two white lights from among the first white light, the second white light, and the third white light, where the first current, the second current, and the third current are adjustable independent of each other.

In another example embodiment, a lighting device includes a light source that includes a first string of light emitting diodes (LEDs) to emit a first white light having a first Correlated Color Temperature (CCT), a second string of LEDs to emit a second white light having a second CCT, and a third string of LEDs to emit a third white light having a third CCT. The light source provides an output light that includes two white lights from among the first white light, the second white light, and the third white light. The lighting fixture further includes a driver configured to provide a first current to the first string of LEDs, a second current to the second string of LEDs, and a third current to the third string of LEDs. The driver is configured to change an amount of the first current, an amount of the second current, and an amount of the third current to adjust a CCT of the output light, where the first current, the second current, and the third current are adjustable independent of each other.

In another example embodiment, a method of tuning an output white light provided by a light source is described, where the method includes providing a first string of light emitting diodes (LEDs) that emit a first white light having a first white Correlated Color Temperature (CCT), providing a second string of LEDs that emit a second white light having a second white CCT, and providing a third string of LEDs that emit a third white light having a third white CCT. The output white light includes two white lights from among the first white light, the second white light, and the third white light. The method further includes controlling by an LED driver, based on a CCT setting input received by the driver, an amount of a first current provided to the first string of LEDs, an amount of a second current provided to the second strings of LEDs, and an amount of a third current provided to the third string of LEDs to adjust a CCT of the output light, where the first current, the second current, and the third current are adjustable independent of each other.

These and other aspects, objects, features, and embodiments will be apparent from the following description and the appended claims.

BRIEF DESCRIPTION OF THE FIGURES

Reference will now be made to the accompanying drawings, which are not necessarily drawn to scale, and wherein.

Figure 1:
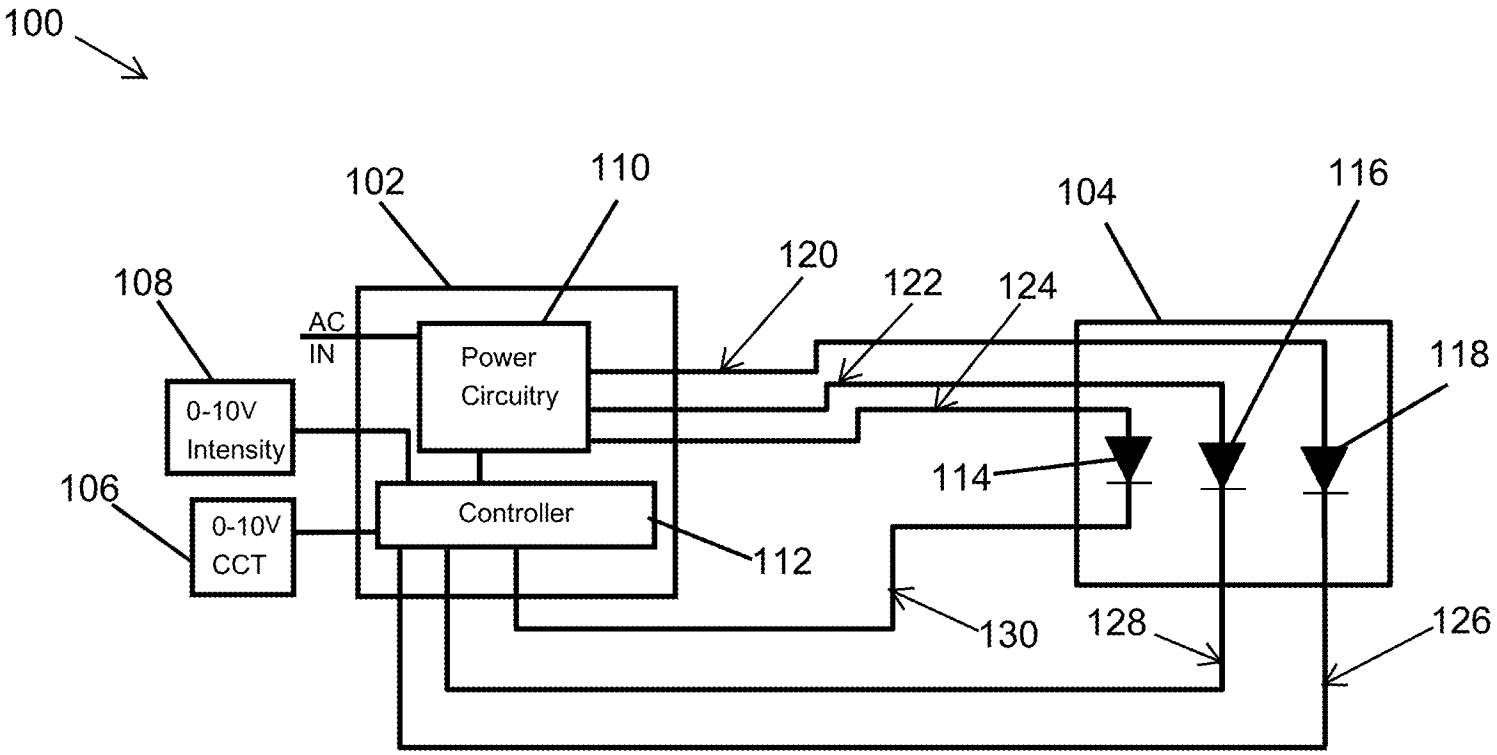
FIG. 1 illustrates a lighting system including a driver for adjusting the Correlated Color Temperature (CCT) of a light according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, reference numerals designate like or corresponding, but not necessarily identical, elements.

DETAILED DESCRIPTION OF THE EXAMPLE EMBODIMENTS

In the following paragraphs, example embodiments will be described in further detail with reference to the figures. In the description, well known components, methods, and/or processing techniques are omitted or briefly described. Furthermore, reference to various feature(s) of the embodiments is not to suggest that all embodiments must include the referenced feature(s).

Turning now to the figures, particular example embodiments are described. FIG. 1 illustrates a lighting system 100 including a driver 102 for adjusting the Correlated Color Temperature (CCT) of a light according to an example embodiment. In some example embodiments, the lighting device 100 includes the driver 102 and a light source 104. The driver 102 is coupled to the light source 104 and provides power to the light source 104. The light source 104 can emit a light that has a particular CCT and intensity based on the amounts of electrical currents provided by the driver 102. For example, the driver 102 may provide power to the light source 104 over connections 120, 122, 124 that may each be one or more electrical wires, wire traces, or a combination thereof. The driver 102 may provide to the light source 104 a first current over the connection 120, a second current over the connection 122, and a third current over the connection 124, and the CCT and intensity level of the light emitted by the light source 104 depend on the amounts of the currents.

In some example embodiments, the driver 102 may be coupled to a 0-10V control unit 106 that provides a CCT setting input to the driver 102. For example, the 0-10V control unit 106 may be coupled to the driver 102 by one or more electrical wires. To illustrate, the 0-10V control unit 106 may be a wall mount unit, a part of a wall station unit with multiple controls, or another type of unit that provides the CCT setting input to the driver 102 (more specifically the controller 112). Based on the CCT setting input received by the driver 102 from the 0-10V control unit 106, the driver 102 may control the light source 104 to adjust the CCT of the light emitted by the light source 104.

To illustrate, the 0-10V control unit 106 may provide to the driver 102 a signal with voltage levels ranging between 0 and 10 volts, where different voltage levels of the signal correspond to different CCT values. Based on the particular voltage level of the signal received from the 0-10V control unit 106, the driver 102 may adjust the currents provided to the light source 104 over the connections 120, 122, 124 to adjust the CCT of the light emitted by the light source 104 to correspond to the voltage level of the signal received from the 0-10V control unit 106. In some alternative embodiments, the CCT setting input may be received wirelessly by the driver 102 as described with respect to FIG. 5.

In some example embodiments, the driver 102 may be coupled to a 0-10V control unit 108 that provides a dim level/intensity level setting input to the driver 102. For example, the 0-10V control unit 108 may be coupled to the driver 102 by one or more electrical wires. To illustrate, the 0-10V control unit 108 may be a wall mount unit, a part of a wall station unit with multiple controls, or another type of unit that provides the dim level setting input to the driver 102. In some example embodiments, the 0-10V control unit 106 and the 0-10V control unit 108 may be integrated into a single unit, such as a single wall mount unit. Based on the dim level setting input received by the driver 102 from the 0-10V control unit 108, the driver 102 may control the light source 104 to adjust the dim level of the light emitted by the light source 104.

To illustrate, the 0-10V control unit 108 may provide to the driver 102 a signal with voltage levels ranging between 0 and 10 volts, where different voltage levels of the signal correspond to different dim levels. Based on the particular voltage level of the signal received from the 0-10V control unit 108, the driver 102 may adjust the currents provided to the light source 104 over the connections 120, 122, 124 to adjust the intensity level of the light emitted by the light source 104 to correspond to the voltage level of the signal received from the 0-10V control unit 108. In some alternative embodiments, the dim level setting input may be received wirelessly by the driver 102 as described with respect to FIG. 5.

In some example embodiments, the light source 104 includes at least three strings of light emitting diodes (LEDs). For example, the light source 104 may include a first string of LEDs 114, a second string of LEDs 116, and a third string of LEDs 118. For example, the first string of LEDs 114, the second string of LEDs 116, and the third string of LEDs 118 may each emit a respective white light such that the light provided by the light source 104 is a combination of the white lights emitted by the string of LEDs 114, 116, 118. The CCT of the output light provided by the light source 104 may be changed by changing the intensity level of the individual white lights from the strings of LEDs 114, 116, 118.

To illustrate, the first string of LEDs 114 may emit a white light that has a warm CCT. For example, the light emitted by the first string of LEDs 114 may have a CCT of 2700K. The third string of LEDs 118 may emit a white light that has a cool CCT. For example, the light emitted by the third string of LEDs 118 may have a CCT of 6500K. The second string of LEDs 116 may emit a white light that has a CCT that is between the warm CCT and the cool CCT. For example, the light emitted by the second string of LEDs 116 may have a CCT of 4000K. In some example embodiments, the CCT of the lights emitted by the individual strings of LEDs 114, 116, 118 may range between the 1000K and 10000K.

In some example embodiments, the driver 102 includes power circuitry 110 and a controller 112. The power circuitry 110 may provide currents to the light source 104 via the connections 120, 122, 124. The controller 112 may control operations of the power circuitry 110 to control the amount of each current that is provided to the light source 104. For example, the controller 112 may include a microcontroller or a microprocessor and a memory device along with other supporting components. For example, executable software code may be stored in the memory device for execution by the microcontroller or the microprocessor to perform operations of the controller 112. For example, the controller 112 may provide pulse width modulation (PWM) signals to the power circuitry 110 to adjust the amounts of the currents that the power circuitry 110 provides to the light source 104, for example, by changing the pulse width of one or more of the PWM signals provided to the power circuitry 110. For example, the controller 112 may change the pulse width of one or more of the PWM signals provided to the power circuitry 110 based on a CCT setting input received from the 0-10V control unit 106.

In some example embodiments, the power circuitry 110 may include an AC/DC converter to convert the AC power signal to DC power. The driver 102 may receive the AC power via the AC IN connection of the driver 102, for example, from the mains power supply. For example, the AC power signal received by the driver 102 may be in the range of 120 to 277 volts. The AC/DC converter may receive AC power signal and output an isolated +55 Vdc power signal, an isolated +15 Vdc power signal, and and/or a +5 Vdc power signal.

In some example embodiments, the power circuitry 110 may also include DC/DC converter circuitry that converts the DC power from the AC/DC converter to DC power compatible with the light source 104. For example, the power circuitry 110 may include multiple AC/DC converter circuits that each operate as a constant current source that provides a respective current to the light source 104. The controller 112 may control the power circuitry 110 to control the amount of current provided to each string of LEDs 114, 116, 118 over the connections 124, 122, 120, respectively. In some example embodiments, the controller 112 may control the power circuitry 110 such that the current provided to any one of the strings of LEDs 114, 116, 118 is adjustable without diverting current to or from the other strings of LEDs 114, 116, 118.

In some example embodiments, the driver 102 may adjust the amounts of the currents provided to the string of LEDs 114, 116, 118 of the light source 104 to change the CCT of the light provided by the light source 104. For example, in response to a change in the CCT setting input received from the 0-10V control device 106, the controller 112 may adjust the pulse width of the PWM signals provided to the power circuitry 110 such that the current provided to the string of LEDs 114 and the current provided to the string of LEDs 116 are changed. To illustrate, when powered on, the string of LEDs 114 may emit a white light that has CCT of 2700K, the string of LEDs 116 may emit a white light that has CCT of 4000K, and the string of LEDs 118 may emit a white light that has CCT of 6000K.

In some example embodiments, the output light provided by the light source 104 may be from just one of the strings of LEDs 114, 116, 118. To illustrate, when the CCT setting input from the 0-10V control device 106 corresponds to a CCT of 2700K, the controller 112 may control the power circuitry 110 such that the string of LEDs 114 are turned on and the strings of LEDs 116, 118 are turned off. For example, the controller 112 may monitor the amounts of current flowing through the strings of LEDs 114, 116, 118 via the connections 130, 128, 126, respectively, that electrically couple the light source 104 to the controller 112. When the CCT setting input from the 0-10V control device 106 corresponds to a CCT of 4000K, the controller 112 may control the power circuitry 110 such that the string of LEDs 116 is turned on and the strings of LEDs 114, 118 are turned off. When the CCT setting input from the 0-10V control device 106 corresponds to a CCT of 6500K, the controller 112 may control the power circuitry 110 such that the string of LEDs 118 is turned on and the strings of LEDs 114, 116 are turned off.

In some example embodiments, two of the three strings of LEDs 114, 116, 118 may emit a respective white light of different color temperatures as described above to produce the output light with a desired CCT corresponding to the CCT setting input. To illustrate, two of the three strings of LEDs 114, 116, 118 may emit a respective white light to produce the output light with a desired CCT corresponding to the CCT setting input. For example, considering the CCTs of the white lights from the strings of LEDs 114, 116, 118 as increasing in the given order, until the desired CCT exceeds the CCT of the white light from the string of LEDs 116, the string of LEDs 118 may be off. When the desired CCT is between the CCTs of the white lights provided by the string of LEDs 116, 118, the string of LEDs 114 may be off.

In some example embodiments, the sum of the amounts of currents provided to the strings of LEDs 114, 116, 118 may be the same amount regardless of the number of strings of LEDs 114, 116, 118 that are on or off. For example, the amount of current provided to the string of LEDs 114 on the connection 124 when the strings of LEDs 116, 118 are off may be the same amount of current provided to the string of LEDs 116 on the connection 122 when the strings of LEDs 114, 118 are off. The amount of current provided to the string of LEDs 114 on the connection 124 when the strings of LEDs 116, 118 are off may also be the same amount of current provided to the string of LEDs 118 on the connection 120 when the strings of LEDs 114, 116 are off. In some alternative embodiments, the amount of current provided to the string of LEDs 114 when the strings of LEDs 116, 118 are off may be different from the amount of current provided to the string of LEDs 116 when the other strings of LEDs 114, 118 are off and may be different from the amount of current provided to the string of LEDs 118 when the other strings of LEDs 114, 116 are off. For example, the amounts of currents may be different to compensate for differences in efficiencies of the strings of LEDs 114, 116, 118.

In some example embodiments, a user may change the 0-10V control device 106 to change a CCT of the light provided by the light source 104 to between the 2700K and 4000K, where, for example, the CCT of the white light emitted by the string of LEDs 114 is 2700K and the CCT of the white light emitted by the string of LEDs 116 is 4000K. In such cases, the driver 102 may change the amount of current provided to the string of LEDs 114 and the amount of current provided to the string of LEDs 116 to change the intensities of the white lights from the strings of LEDs 114, 116 to produce the output light from the light source 104 with the desired CCT. When the CCT setting input from the 0-10V control device 106 corresponds to a CCT that is at or below 4000K, the driver 102 may turn off or keep turned off the string of LEDs 118. That is, when the CCT of the light from the light source 104 is at or below 4000K, the strings of LEDs 118 may be off. When the CCT setting input from the 0-10V control device 106 corresponds to 4000K or above, the driver 102 may turn off or keep tuned off the string of LEDs 114. That is, when the CCT of the light from the light source 104 is at or above 4000K, the strings of LEDs 114 may be off.

In some example embodiments, the driver 102 may maintain the sum of the amounts of the currents provided to the string of LEDs 114, 116, 118 substantially constant. To increase the CCT of the light from the light source 104 from one CCT value that is below 4000K to another CCT value that is also at or below 4000K, the driver 102 may increase the amount of current provided to the string of LEDs 116 by the same amount that the driver 102 decreases the current provided to the string of LEDs 114. To increase the CCT of the light from the light source 104 from one CCT value that is at or above 4000K to another CCT value that is also above 4000K, the driver 102 may increase the amount of current provided to the string of LEDs 118 by the same amount that the driver 102 decreases the current provided to the string of LEDs 116.

To decrease the CCT of the light from the light source 104 from a CCT value that is at or below 4000K, the driver 102 may increase the amount of current provided to the string of LEDs 114 by the same amount that the driver 102 decreases the current provided to the string of LEDs 116. To decrease the CCT of the light from the light source 104 from a CCT value that is above 4000K to another CCT value that is at or above 4000K, the driver 102 may increase the amount of current provided to the string of LEDs 116 by the same amount that the driver 102 decreases the current provided to the string of LEDs 118.

To decrease the CCT of the light from the light source 104 from a CCT value that is above 4000K to another CCT that is below 4000K, the driver 102 may increase the current provided to the string of LEDs 114 by the sum of the amounts of the currents that the driver 102 decreases from the strings of LEDs 116, 118. To increase the CCT of the light from the light source 104 from a CCT value that is below 4000K to another CCT that is above 4000K, the driver 102 may decrease the current provided to the string of LEDs 118 by the sum of the amounts of the currents that the driver 102 decreases from the strings of LEDs 114, 116.

In some alternative embodiments, when the CCT of the light from the light source 104 is changed in response to a change in the CCT setting input from the 0-10V control device 106, the driver 102 may change the amounts of currents provided to the string of LEDs 114, 116, 118 such that the sum of the currents is also changed. To illustrate, when the CCT of the light is increased (i.e., made cooler), the driver 102 may decrease the sum of the amounts of the currents provided to two strings of LEDs (e.g., the strings of LEDs 114, 116 or the strings of LEDs 116, 118) to compensate for higher efficiency of cooler light LEDs. When the CCT of the light is decreased, the driver 102 may increase the sum of the amounts of the currents provided to two strings of LEDs (e.g., the strings of LEDs 114, 116 or the strings of LEDs 116, 118) to compensate for lower efficiency of warmer light LEDs. The amounts of the currents provided to the string of LEDs 114, 116, 118 are adjustable by the driver 102 independent of each other to change the sum of the currents to compensate for the differences in the efficiencies of the strings of LEDs 114, 116, 118.

By compensating for the differences in the efficiencies of the strings of LEDs 114, 116, 118, the driver 102 may control the light source 104 to emit an output light that has a substantially the same intensity/dim level at different CCTs. That is, the driver 102 may maintain the intensity/dim level of the light from the light source 104 substantially constant while adjusting two or more of the first current, the second current, and the third current provided to the string of LEDs 114, 116, 118 of the light source 104 to change the CCT of the output light provided by the light source 104.

For example, when the driver 102 changes the amounts of the currents provided to the strings of LEDs 114, 116 to increase the CCT of the output light from the light source 104, the sum of the amounts of the currents that result in the higher CCT may be less than the sum of the amounts of the currents at the lower CCT. Because the CCT of the light from the light source 104 depends on the ratio of the intensities of the white lights from the two strings of LEDs 114, 116, the amounts of the currents provided to the strings of LEDs 114, 116 may be proportionally less than the amounts of the currents that would otherwise be provided to the strings of LEDs 114, 116 absent the compensation for differences in efficiencies.

As another example, when the driver 102 changes the amounts of the currents provided to the strings of LEDs 114, 116 to decrease the CCT of the light from the light source 104, the sum of the amounts of the currents that result in the lower CCT may be more than the sum of the currents prior to the change. The amounts of the currents provided to the strings of LEDs 114, 116 may be proportionally higher than the amounts of the currents that would otherwise be provided to the strings of LEDs 114, 116 absent the compensation for differences in efficiencies.

As another example, when the driver 102 changes the amounts of the currents provided to the strings of LEDs 116, 118 to decrease or increase the CCT of the light from the light source 104, the sum of the amounts of the currents that result in the lower or higher CCT may be respectively more or less than the sum of the currents prior to the change. The amounts of the currents provided to the strings of LEDs 116, 118 may be proportionally higher or lower than the amounts of the currents that would otherwise be provided to the strings of LEDs 116, 118 absent the compensation for differences in efficiencies.

In some example embodiments, when the dim level setting input from the 0-10V control unit 108 is changed to adjust the intensity of the light from the light source 104, the amounts of the currents provided to the strings of LEDs 114, 116, 118 that contribute to the light are proportionally adjusted to such that the CCT of the light continues to correspond to the CCT setting input received from the 0-10V control unit 106. For example, although the amounts of the currents provided to the strings of LEDs 114, 116 may be reduced to reduce the intensity of the output light provided by the light source 104, the driver 102 may maintain the ratio of the amount of the current provided to the string of LEDs 114 to the amount of the current provided to the string of LEDs 116 substantially constant to keep the CCT of the output light substantially unchanged.

Although three strings of LEDs are shown in FIG. 1, in alternative embodiments, the light source 104 may include two or more than three strings of LEDs without departing from the scope of this disclosure. Although particular components and connections are shown in FIG. 1, the system 100 may include other components and connections without departing from the scope of this disclosure. In some example embodiments, each string of LEDs 114, 116, 118 may include multiple LEDs that are in series, in parallel, or combination thereof. Each string of LEDs 114, 116, 118 may emit a white light that is produced by means such as a combination of colored lights or other means known to those of ordinary skill in the art with the benefit of this disclosure. The lights emitted by the strings of LEDs 114, 116, 118 may have CCTs other than those provided above as examples. Although the strings of LEDs 114, 116, 118 are described as emitting white lights, in some alternative embodiments, the strings of LEDs 114, 116, 118 may emit colored lights such as red, green and blue lights. In some example embodiments, one or both of the driver 102 and the light source 104 may be included in a lighting fixture.

Figure 2:
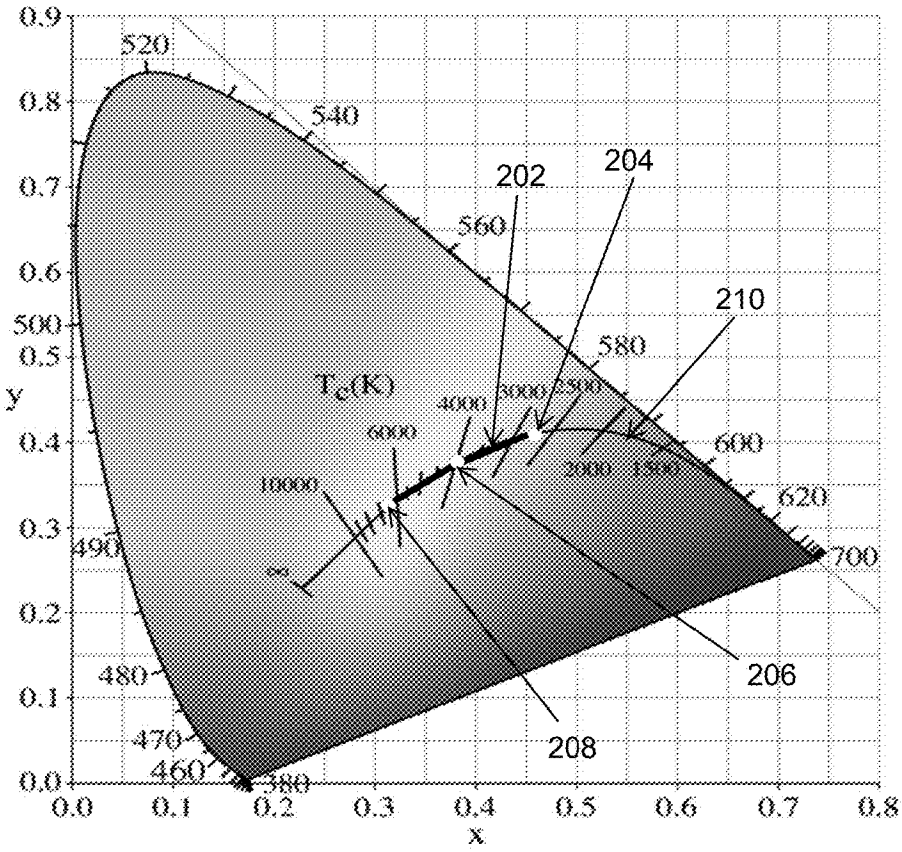
FIG. 2 illustrates a white light tuning path curve on the CIE-1931 chromaticity chart of the light controlled by the driver of FIG. 1 relative to a black-body curve according to an example embodiment.

FIG. 2 illustrates a white light tuning path curve 202 of the light controlled by the driver of FIG. 1 relative to a black-body curve 210 according to an example embodiment. Referring to FIGS. 1 and 2, in some example embodiments, the CCT point 204 of the curve 202 may correspond to the CCT of the white light emitted by the string of LEDs 114, and the CCT point 206 may correspond to the CCT of the white light emitted by the string of LEDs 116, and the CCT point 208 may correspond to the CCT of the white light emitted by the string of LEDs 118. For example, the CCT point 204 may be a warm CCT of 2700K, the CCT point 206 may be a CCT of 4000K, and the CCT point 208 may be a cool CCT of 6500K. To illustrate, the CCT of the output light provided by the light source 104 may be at or between 2700K and 6500K depending on which one or two string of LEDs are turned on at one particular time. As illustrated in FIG. 2, the white light tuning path curve 202 closely matches the black-body curve 210.

For example, the string of LEDs 118 may be off when the CCT of the output light is at or below 4000K, and the string of LEDs 114 may be off when the CCT of the output light is at or above 4000K. When the driver 102 changes the amounts of the currents that are provide to the strings of LEDs 114, 116, 118, the driver 102 may maintain the sums of the currents substantially constant or may adjust the sum of the currents proportionally to maintain substantially constant lumen output (i.e., intensity level) of the output light provided by the light source 104.

As illustrated in FIG. 2, the white light tuning path curve 202 closely matches the black-body curve 210. By using three strings of LEDs 114, 116, 118 that provide white lights with different CCTs, the white light tuning curve can desirably be keep close to the black body curve for a wider range of CCTs that possible with just two strings of LEDs. Further, by compensating for the differences in the efficiencies of the different strings of LEDs 114, 116, 118 by proportionally adjusting the currents provided to the strings of LEDs, the intensity level of the light provided by the light source 104 may be maintained substantially constant at different CCTs unless the intensity level is changed in response to the dim/intensity level setting input, for example, from the 0-10V control unit 108.

Although particular CCT points are shown in FIG. 2, in alternative embodiments, the white light tuning path curve 202 may extend between and include other CCT values. For example, the white light tuning path curve 202 may extend between other CCT values in the CCT range of 2000K and 10000K including between 2000K and 10000K.

Figure 3:
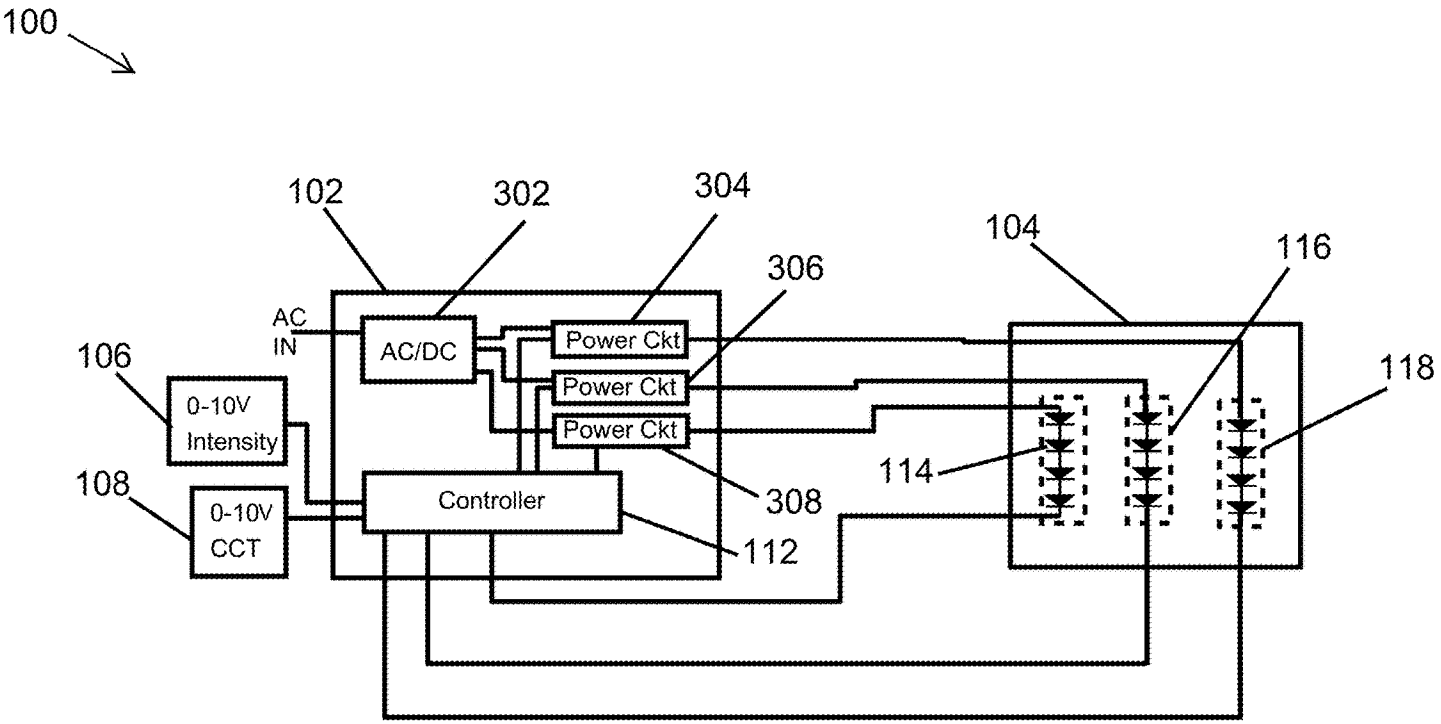
FIG. 3 illustrates details of the lighting system of FIG. 1 according to an example embodiment.

FIG. 3 illustrates details of the lighting system 100 of FIG. 1 according to an example embodiment. Referring to FIGS. 1 and 3, the lighting system 100 includes the driver 102, the light source 104, the 0-10V control units 106, 108 that are electrically coupled to the driver 102. In some example embodiments, the driver 102 may include an AC/DC converter 302 (e.g., a rectifier and a voltage source) that can convert AC power signal received via the AC IN input connection of the driver 102 to one or more DC signals. The driver 102 may also include power circuits 304, 306, 308 that operate as constant current sources based on the respective control signals provided by the controller 112 to control the amount of current that each of the power circuits 304, 306, 308 provides to the respective one of the strings of LEDs 114, 116, 118. For example, the power circuits 304, 306, 308 may each include a DC/DC converter along with additional components to generate constant current. In some example embodiments, the power circuits 304, 306, 308 may each provide a respective a PWM signal as a current signal to the respective one of the strings of LEDs 114, 116, 118.

For example, the power circuit 304 may provide power to the string of LEDs 118, the power circuit 306 may provide power to the string of LEDs 116, and the power circuit 308 may provide power to the string of LEDs 114. Each string of LEDs 114, 116, 118 may include a number of LEDs that may be in series with each other. Alternatively, the strings of LEDs 114, 116, 118 may include LEDs that are coupled in a different configuration than shown without departing from the scope of this disclosure. Each string of LEDs 114, 116, 118 may include discrete LEDs, organic light emitting diodes (OLEDs), an LED chip on board that includes discrete LEDs, or an array of discrete LEDs, etc.

In some example embodiments, the controller 112 controls the power circuits 304, 306, 308 to control the amounts of currents provided to the light source 104 in substantially the same manner as described with respect to FIG. 1. For example, the controller 112 may provide a respective signal (e.g., a PWM signal) to each of the power circuits 304, 306, 308 to control the amounts of currents provided to the strings of LEDs 114, 116, 118. The controller 112 may adjust the amounts of currents provided to the strings of LEDs 114, 116, 118 by the power circuits 304, 306, 308 to adjust the CCT of the output light based on the CCT setting input from the 0-10V control unit 106. The controller 112 may also adjust the amounts of currents to compensate for differences in the efficiencies of the strings of LEDs 114, 116, 118 so that the intensity level of the output light from the light source 104 is fairly constant at different CCTs.

As described above, the controller 112 may also adjust the amounts of currents provided to the strings of LEDs 114, 116, 118 by the power circuits 304, 306, 308 to adjust the intensity/dim level of the output light based on the dim level setting input from the 0-10V control unit 108 while maintaining the CCT of the output light fairly constant at the different intensity levels. For example, the controller 112 can maintain the ratio of the amounts of the currents fairly constant as the amounts of the currents are increased or decreased to change the dim/intensity level of the light from the light source 104.

Although particular components and connections are shown in FIG. 3, in alternative embodiments, the driver 102 may include other components and connections without departing from the scope of this disclosure. Although a particular number of LEDs and configuration are shown, in alternative embodiments, each string of LEDs of the light source 104 may include fewer or more LEDs in the same or different configuration than shown without departing from the scope of this disclosure.

Figure 4:
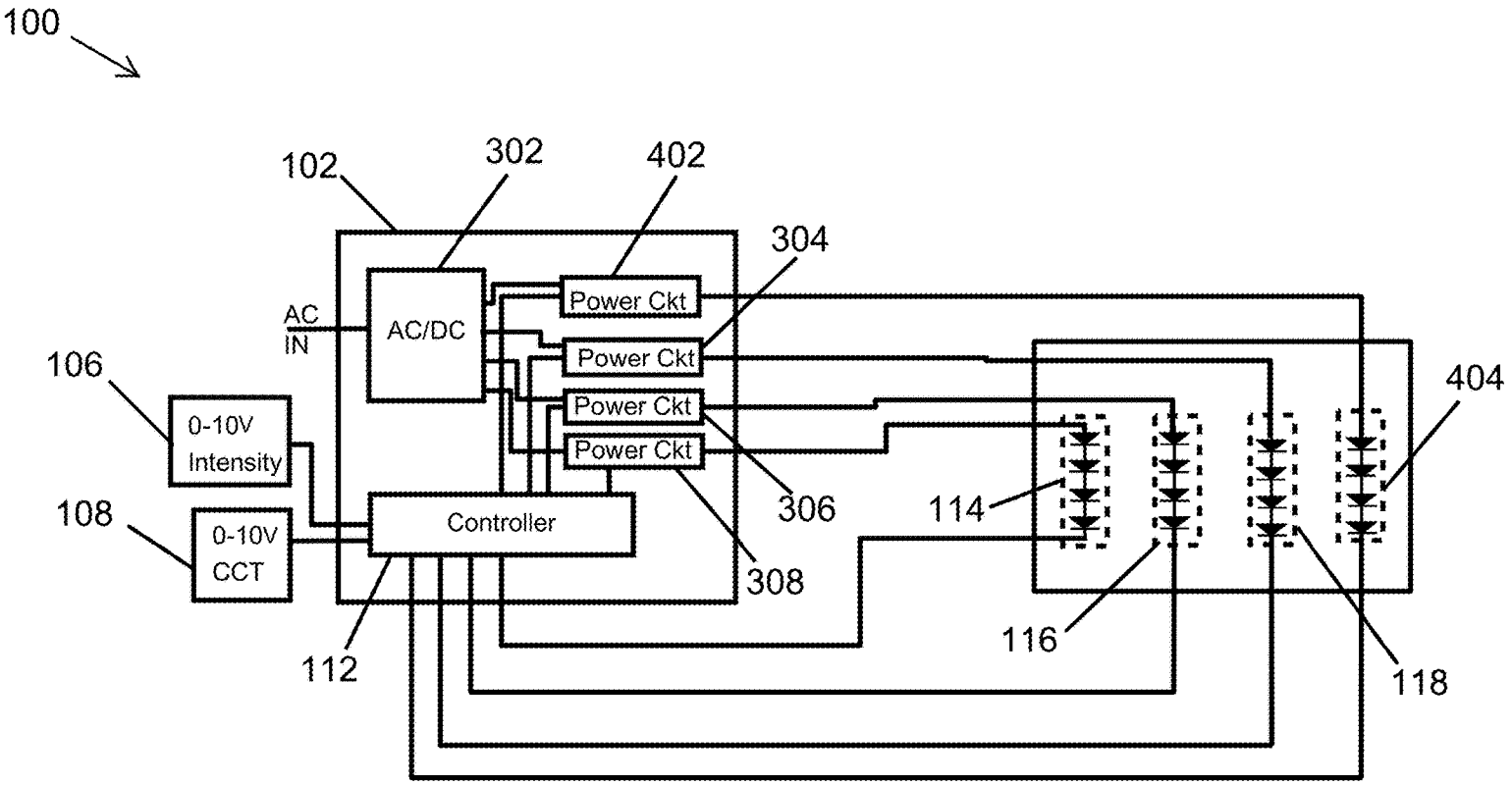
FIG. 4 illustrates details of the lighting system of FIG. 1 according to another example embodiment.

FIG. 4 illustrates details of the lighting system of FIG. 1 according to another example embodiment. Referring to FIGS. 1, 3, and 4, in some example embodiments, the lighting system 100 includes the driver 102, the light source 104, the 0-10V control units 106, 108 that are electrically coupled to the driver 102. The driver 102 may include the AC/DC converter 302 that can convert AC power signal received via the AC IN input connection of the driver 102 to one or more DC signals. The driver 102 may also include the power circuits 304, 306, 308 and a power circuit 402 that operates in the same manner as the power circuits 304, 306, 308. For example, the light source 104 may include the strings of LEDs 114, 116, 118 and a string of LEDs 404, and the controller 112 may control the amount of current that each of the power circuits 304, 306, 308, 402 provides to the respective one of the strings of LEDs 114, 116, 118, 404.

To illustrate, the string of LEDs 404 may emit a white light that has a CCT that is different from the CCTs of the white lights emitted by the strings of LEDs 114, 116, 118. For example, the CCT of the white light emitted by the string of LEDs 404 may be lower (i.e., warmer) or higher (i.e., cooler) than one or more of CCTs of the white lights emitted by the strings of LEDs 114, 116, 118. In some example embodiments, the use of four strings of LEDs instead of fewer strings of LEDs may allow for a broader range of CCTs of the output light provided by the light source 104 while providing a white light tuning path that closely matches the black body curve.

In some example embodiments, two of the four strings of LEDs 114, 116, 118, 404 may emit a respective white light to produce the output light with a desired CCT corresponding to the CCT setting input. For example, considering the CCTs of the white lights from the strings of LEDs 114, 116, 118, 404 as increasing in the given order, until the desired CCT exceeds the CCT of the white light from the string of LEDs 116, the strings of LEDs 118, 404 may be off. When the desired CCT is between the CCTs of the white lights provided by the string of LEDs 116, 118, the strings of LEDs 114, 404 may be off. When the desired CCT exceeds the CCT of the white light provided by the string of LEDs 118, the strings of LEDs 114, 116 may be off.

In some alternative embodiments, the strings of LEDs 114, 116, 118, 404 may emit red, green, blue, and white lights. For example, the first string of LEDs 114 may emit a red light, the string of LEDs 116 may emit a blue light, the string of LEDs 118 may emit a blue light, and the string of LEDs 404 may emit a white light. The amounts of the currents provided to the LEDs 114, 116, 118, 402 by the power circuits 304, 306, 308, 402 may be changed in a similar manner as described above to achieve a CCT of the output light that corresponds to the CCT setting input received from the 0-10V control unit 106. The intensity of the output light from the light source 104 may also be adjusted in a similar manner as described above.

Although particular components and connections are shown in FIG. 4, in alternative embodiments, the driver 102 may include other components and connections without departing from the scope of this disclosure. Although a particular number of LEDs and configuration are shown, in alternative embodiments, each string of LEDs of the light source 104 may include fewer or more LEDs in the same or different configuration than shown without departing from the scope of this disclosure.

Figure 5:
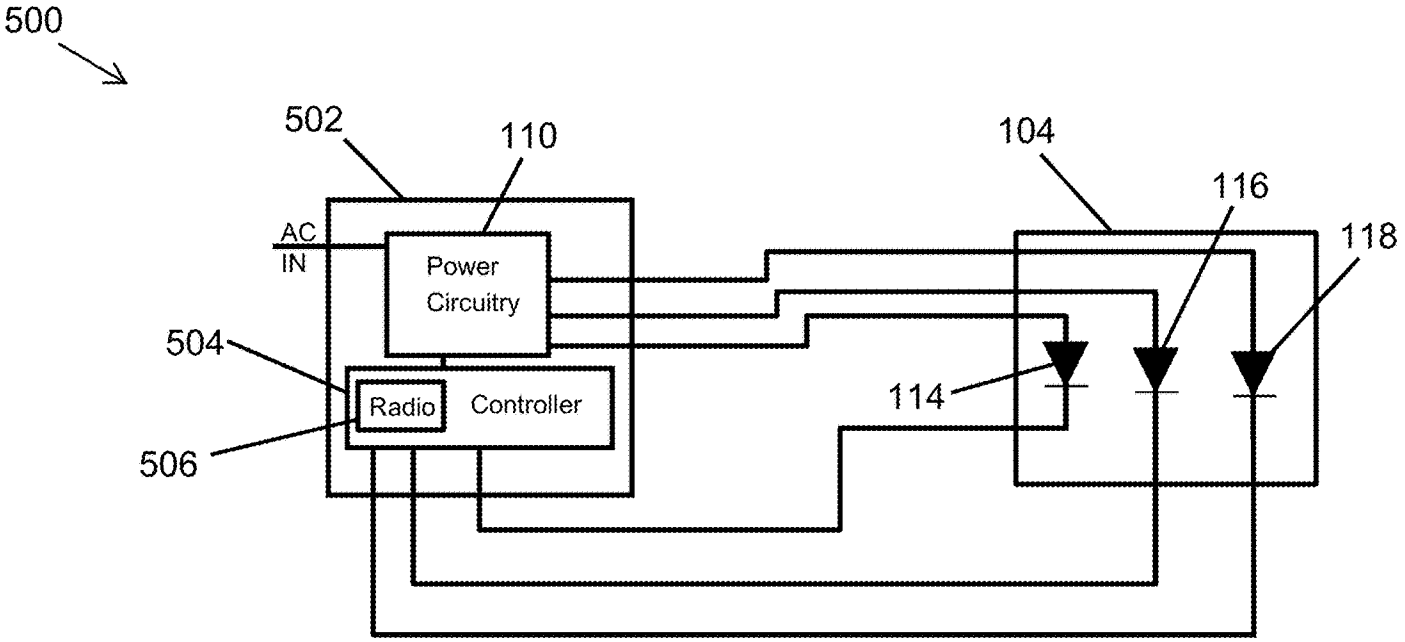
FIG. 5 illustrates a lighting system including a driver for adjusting Correlated Color Temperature (CCT) using radio frequency control of a light according to another example embodiment.

FIG. 5 illustrates a lighting system 500 including a driver 502 for adjusting Correlated Color Temperature (CCT) of a light according to another example embodiment. In some example embodiments, the system 500 operates substantially the same manner as the lighting system 100. For example, the light source 104 may be the same or similar light source 104 as shown in FIGS. 1, 3, and 4, and the driver 502 operates substantially the same manner as the driver 102. Focusing on the differences between the lighting systems 100, 500, the controller 504 of FIG. 5 includes a transceiver 506 that receives wireless signals. For example, the transceiver 506 may receive CCT setting input, dim level setting input, and other inputs wirelessly, and the controller 504 may control the power circuitry 110 as described above based on the inputs received by the transceiver 506. For example, the transceiver 506 may receive wireless signals that are compatible with ZigBee, BLE, etc. The CCT setting input and other inputs may be received from a wireless control device, such as a portable wireless device, a wall mounted wireless device, etc.

Although the transceiver (Radio) 506 is shown as part of the controller 504, in some alternative embodiments, the transceiver (Radio) 506 may external to the controller 504. In some alternative embodiments, the transceiver (Radio) 506 may be a receiver (i.e., without a wireless transmitting capability). In some alternative embodiments, the power circuitry 110 may include the power circuits shown in FIG. 3, FIG. 4, or other components to generate constant current based the control signals provided by the controller 504 in the same manner as described above.

Although particular embodiments have been described herein in detail, the descriptions are by way of example. The features of the example embodiments described herein are representative and, in alternative embodiments, certain features, elements, and/or steps may be added or omitted. Additionally, modifications to aspects of the example embodiments described herein may be made by those skilled in the art without departing from the spirit and scope of the following claims, the scope of which are to be accorded the broadest interpretation so as to encompass modifications and equivalent structures.

What is claimed is:

1. A driver of a lighting fixture, the driver comprising:

a power circuitry configured to provide:

a first direct-current (DC) current over a first electrical connection to a first string of light emitting diodes (LEDs) of a light source that emit a first white light having a first correlated color temperature (CCT);

a second DC current over a second electrical connection to a second string of LEDs of the light source that emit a second white light having a second CCT; and a third DC current over a third electrical connection to a third string of LEDs of the light source that emit a third white light having a third CCT; and a controller that controls the power circuitry to change an amount of the first DC current, an amount of the second DC current, and an amount of the third DC current to adjust a CCT of an output light provided by the light source, wherein the output light includes two white lights from among the first white light, the second white light, and the third white light, wherein the controller is configured to control the power circuitry such that, when the driver is set to a first CCT value, the first DC current is off and the third DC current is on and when the driver is set to a second CCT value, the third DC current is off and the first DC current is on resulting in the CCT of the output light being closer to the black-body curve compared to a CCT of a combined light that is a combination of the first white light and the third white light when the driver is set to the first CCT value or the second CCT value and both the first DC current and the third DC current are on, wherein the first CCT is warmer than the second CCT, wherein the second CCT is warmer than the third CCT, and wherein the first DC current, the second DC current, and the third DC current are adjustable independent of each other, wherein the driver controls the power circuitry to change the amount of the first DC current, the amount of the second DC current, and the amount of the third DC current based on a CCT setting input received by the driver from a 0-10V user control unit, wherein the controller is configured to monitor the amount of the first DC current, the amount of the second DC current, and the amount of the third DC current.

2. The driver of claim 1, wherein the controller controls the power circuitry to change the amount of the first current, the amount of the second current, and the amount of the third current to adjust the CCT of the output light from the first CCT value to the second CCT value and wherein an intensity level of the output light is the same at the first CCT value and at the second CCT value.

3. The lighting device of claim 1, wherein the driver controls the power circuitry to change the amount of the first DC current, the amount of the second DC current, and the amount of the third DC current based on a CCT setting input wirelessly received by the driver.

4. The driver of claim 1, wherein the power circuitry comprises:

a first power circuit that operates as a first constant current source and that provides the first DC current;

a second power circuit that operates as a second constant current source and that provides the second DC current; and a third power circuit that operates as a third constant current source and that provides the third DC current.

5. The driver of claim 4, wherein the power circuitry further comprises a fourth power circuit that is a fourth constant current source and that provides a fourth DC current to a fourth string of LEDs that emit a fourth white light having a fourth CCT and wherein the output light includes the fourth white light when the CCT of the output light as higher than the third CCT.

6. The driver of claim 1, wherein the driver is further configured to change the amount of the first DC current, the amount of the second DC current, and the amount of the third DC current based on a dimmer setting input received by the driver.

7. A lighting device, comprising:

a light source comprising:

a first string of light emitting diodes (LEDs) to emit a first white light having a first Correlated Color Temperature (CCT);

a second string of LEDs to emit a second white light having a second CCT; and a third string of LEDs to emit a third white light having a third CCT, wherein the light source provides an output light that includes two white lights from among the first white light, the second white light, and the third white light; and a driver configured to provide a first direct-current (DC) current to the first string of LEDs over a first electrical connection, a second DC current to the second string of LEDs over a second electrical connection, and a third DC current to the third string of LEDs over a third electrical connection, wherein the driver is configured to change an amount of the first DC current, an amount of the second DC current, and an amount of the third DC current to adjust a CCT of the output light, wherein a controller of the driver is configured to control a power circuitry of the driver such that, when the driver is set to a first CCT value, the first white light is off and the third white light is on and when the driver is set to a second CCT value, the third white light is off and the first white light is on resulting in the CCT of the output light being closer to the black-body curve compared to a CCT of a combined light that is a combination of the first white light and the third white light when the driver is set to the first CCT value or the second CCT value and both the first light and the third light are on, wherein the first CCT is warmer than the second CCT, wherein the second CCT is warmer than the third CCT, and wherein the first DC current, the second DC current, and the third DC current are adjustable independent of each other, wherein the driver controls the power circuitry to change the amount of the first DC current, the amount of the second DC current, and the amount of the third DC current based on a CCT setting input received by the driver from a 0-10V user control unit, and wherein the controller is configured to monitor the amount of the first DC current, the amount of the second DC current, and the amount of the third DC current.

8. The lighting device of claim 7, wherein the driver is configured to change the amount of the first DC current, the amount of the second DC current, and the amount of the third DC current to adjust the CCT of the output light from the first CCT value to the second CCT value, wherein the first CCT value and the second CCT value are within a range bounded by the first CCT and the third CCT and wherein an intensity level of the output light is the same at the first CCT value and at the second CCT value.

9. The lighting device of claim 7, wherein the driver controls power circuitry to change the amount of the first DC current, the amount of the second DC current, and the amount of the third DC current based on a CCT setting input wirelessly received by the driver.

10. The lighting device of claim 7, wherein the first CCT is approximately 2700K, wherein the second CCT is approximately 4000K, and wherein the third CCT is approximately 6500K.

11. The lighting device of claim 7, wherein the first CCT is a warm CCT, wherein the third CCT is a cool CCT, and wherein the second CCT is between the first CCT and the third CCT.

12. The lighting device of claim 7, wherein the driver is further configured to change the amount of the first DC current, the amount of the second DC current, and the amount of the third DC current to change the intensity of the output light based on a dimmer setting input received by the driver and wherein the CCT of the output light is the same at different intensity levels of the output light.

13. The lighting device of claim 7, wherein the driver comprises:

a first power circuit that operates as a first constant current source and that provides the first DC current;

a second power circuit that operates as a second constant current source and that provides the second DC current; and a third power circuit that operates as a third constant current source and that provides the third DC current.

14. The lighting device of claim 7, further comprising a fourth string of LEDs to emit a fourth white light having a fourth CCT, wherein the fourth CCT is between the first CCT and the second CCT, wherein the output light includes the fourth white light when the CCT of the output light is between the first CCT and the fourth CCT, and wherein the driver is configured to provide a fourth DC current to the fourth string of LEDs.

* * * * *